US005661499A

United States Patent [19]

Epshtein et al.

[11] Patent Number: 5,661,499

[45] Date of Patent: Aug. 26, 1997

[54] SPHERICAL DIELECTRIC LENS WITH VARIABLE REFRACTIVE INDEX

[75] Inventors: Alexandr Lvovich Epshtein; Petr Nikolaevich Korzhenkov; Viktor Pavlovich Filaretov; Alexandr Semenovich Smagin, all of Moscow, Russian Federation

[73] Assignee: Tovarischestvo S Ogranichennoi Otvetstvennostju "Konkur", Moscow, Russian Federation

[21] Appl. No.: 564,127

[22] PCT Filed: Apr. 22, 1994

[86] PCT No.: PCT/RU94/00090

§ 371 Date: Dec. 15, 1995

§ 102(e) Date: Dec. 15, 1995

[87] PCT Pub. No.: WO95/29517

PCT Pub. Date: Nov. 2, 1995

[51] Int. Cl.[6] ..... H01Q 15/08

[52] U.S. Cl. ..... 343/911 R; 343/909

[58] Field of Search ..... 343/911 R, 911 L, 343/909

[56] References Cited

U.S. PATENT DOCUMENTS

| | | | |
|---|---|---|---|
| 2,472,363 | 6/1949 | Blackinton . | |
| 2,669,657 | 2/1954 | Cutler | 343/911 R |
| 2,761,141 | 8/1956 | Strandberg et al. | 343/911 R |
| 3,329,958 | 7/1967 | Anderson | 343/911 R |
| 3,914,769 | 10/1975 | Andrews . | |
| 4,482,513 | 11/1984 | Auletti | 343/911 R X |

OTHER PUBLICATIONS

Schrank, Helmut E., "Precision Spherical Luneberg Lenses for Microwave Antennas", Printed from Proceedings of the 7th Electrical Insulation Conference, Oct. 15–19, 1967.

Supplement to the Record of the CIE 1986 International Conference on Radar, China Academic Publishers, Nanjing:China no month.

"What's New In light Metals" Materials Engineering, Mar. 1968.

Schrank H.E.–In: Proc. 7th Electrical Insulation Conf., New York, 1967, 15–19/X no month.

Proc. Int. Conf. on Radar, China, 1986, 4–7/X1, Suppl., p. 1–53 no month.

*Primary Examiner*—Donald T. Hajec
*Assistant Examiner*—Tho Phan
*Attorney, Agent, or Firm*—Lowe, Price, LeBlanc & Becker

[57] ABSTRACT

The spherical dielectric lens with variable refractive index contains modules (1, 4, 7, 9, 12) connected with one another and made from homogeneous dielectric materials with various ∈ values, which are arranged in accordance with the given principle of change in dielectric permittivity ∈ from the radius value (r) of the lens, uniquely corresponding to the rule of variation of its refractive index (n). The modules (1, 4, 7, 9, 12) of the interior layers, which form the central cubic core, are inscribed in a sphere, are of cubic form and are equal in size, while the exterior modules (1, 4, 7, 9, 12) have an outer surface of spherical form, where the latter interior layer modules (1, 4, 7, 9, 12) fill out the central core up to the sphere. On at least two sides of each module (1, 4, 7, 9, 12) along its entire length are constructed a grooves which are broader to the inside (2, 5, 8, 10, 13, 16, 15) and/or protrusions (3, 11, 14) which have in pairs identical lateral cross-section, by means of which the modules (1, 4, 7, 9, 12) are connected with one another to form the spherical lens surface. Various combinations of construction of the grooves and protrusions on the sides of the module (1, 4, 7, 9, 12) are proposed.

18 Claims, 6 Drawing Sheets

SPHERICAL DIELECTRIC LENS WITH VARIABLE REFRACTIVE INDEX

TECHNICAL FIELD

The present invention relates to lens antennas, more specifically to a spherical dielectric lens with a variable refractive index.

BACKGROUND ART

The unique characteristics of lenses of dielectric materials with variable refractive indices (Luneberg, Maxwell, Eaton and others ) particularly their practically unlimited wide-angle, multi-channel and wide-band characteristics, predetermines the possibility of their effective adoption in multi-channel communications systems, television and radar.

However, wide adoption of the lenses is inhibited by their high cost, since the construction of existing lenses with variable refractive index, which ensure changes in dielectric permittivity with a high degree of accuracy in corresponding to the desired principle, are extremely labor-intensive and demand a large amount of manual labor in production.

Spherical lenses with variable refractive index containing an assembly of covers of a single dielectric are well-known. The dielectric permittivity $\epsilon$ and thickness of each cover is selected to approximate with maximal precision the necessary continuous changes of $\epsilon$ along the lens radius ( Antenna Engineering Handbook, McGraw-Hill Book Co., New York, 1984; Skolnik M. J. Introduction to Radar Systems , McGraw-Hill Book Co., New York, 1980.)

However, for the spherical lenses described above, with an increase in operating frequency, together with the necessary decrease in the absolute layer thickness, there is an increased requirement for precision in construction of the spherical surface and the tolerance for deviations in the value of $\epsilon$ becomes more rigid, which significantly complicates the manufacturing process and increases its, particularly for short wave band and short-wave portion of microwave band.

In addition, a design for spherical dielectric lenses with variable refractive index is known. These lenses contain cubic modules identical in size, with the exclusion of the exterior modules, made from homogeneous dielectric with various values of dielectric permittivity, arranged in horizontal layers parallel to one another in accordance with the principle of change of dielectric permittivity. In these lenses, the cubic modules are connected with one another with an adhesive paste material (Shrank H. E.- In Proc. 7th Electrical Insulation Conf., New York, 1967, 15–19/x).

The properties of the lenses described are significantly better in comparison with analogous lenses, since it is possible to finish modules which are unsatisfactory due to their refractive characteristics, homogeneity or isotropic characteristics.

Furthermore, to ensure the required illumination properties, in lenses of the same diameter a much lower gradation in size of the cubic modules is required, in comparison with the number of covers of spherical form. Thus, for example, the nine-layers lens is equivalent in its properties to the lens created from cubic modules, which has all of four gradations in value $\epsilon$ (Proc. Int. Conf. on Radar, China, 1986 4–7/XI, Suppl., pp. 1–53).

However, in the body of such a lens there are a large quantity of extended discontinuities, formed by the gradations between the modules and the gradations between the module layers, and also discontinuities formed by the adhesive interlayers, which produce additional losses in the lens gain to energy dispersion of up to 2 dB or more, while the regular character of the fraction of discontinuities leads to a frequency dependence of the gain oriented within these same limits. In addition, assembly of the spherical lens is complex and labor-intensive with the adoption of the adhesive composite.

DISCLOSURE OF THE INVENTION

The basis of the present invention is the creation of a spherical dielectric lens with variable refractive index, design of each of the component modules of the lens, and their joints, which provides for lowering the discontinuity of the dielectric medium of the lens, and improvement in its radar properties with a simultaneous increase in stability and rigidity.

The task proposed is resolved such that in the spherical dielectric lens with variable refractive index, consisting of modules made of homogeneous dielectric with various levels of dielectric permittivity, connected to one another, arranged in relation to the desired principle of change in dielectric permittivity from the current lens radius value, identically corresponding to the principle of change in its refractive index, while the modules of interior layers, which form the central cubic core, inscribed in a sphere, are cubic in form and equal in size, while the outer modules are spherical in form on their exterior surfaces, at which point the latter modules when connected to the interior module layers fill out the central core up to a spherical form. According to the invention, on at least two sides of each module along its entire length are constructed grooves which widen inside the module, and/or protrusions which have a mutually identical lateral cross-section, by means of which the modules are connected with one another to form the spherical lens surface.

In this manner, a stable assembly of the modules is ensured without use of adhesives, in a unified lens design. This design solution ensures simplicity, reliability and a highly productive assembly process, and makes possible automation of the process, since the coordinates of the installation spot for each module in its layer is strictly determined, and the coordinates of the points locating the module and the $\epsilon$ values corresponding to them in the case of elements are also known.

The absence of adhesive connections accelerates the assembly process, which decreases its labor-intensiveness and simultaneously improves the quality of the collected dielectric medium.

Employment of protrusions which are inserted into the groove during assembly ensures mutual interconnection of the modules with variable $\epsilon$ and permits a checkerboard arrangement of the modules to be organized in the layer and between the layers, which leads to erosion of the edges between the modules and makes the selected dielectric medium more even, without sharp regular jumps in $\epsilon$ and with a decrease relative to the physical module of equivalent size. All this leads in turn to an improvement in the radio engineering characteristics of the lens, thanks to which the loss in the lens gain is decreased by at least 1–2dB.

One of the proposed design variants for the spherical dielectric lens, in which on one pair of opposite sides of each module are constructed, in parallel, one groove against another, and on the other pair of sides, protrusions, so that the modules are connected with one another by the grooves and corresponding protrusions, so that they are arranged in horizontal layers, in each of which adjacent modules are offset by length relative to one another with the formation of a stepped boundary between the layers.

Such a lens design provides for erosion of the boundaries between the layers and lateral rigidity of the structure.

For creation of the checkerboard arrangement of the modules between the layers in certain cases it is preferable that for one pair of opposite sides of each module along its entire length grooves be constructed so that the greatest width of each groove is equal to the total width of the symmetrical side protrusions formed on the edge along both sides away from the groove.

The modules would be arranged in horizontal layers so that in each groove of each module are inserted from its two opposite sides are inserted the side protrusions of two pairs of adjacent modules, located relative in the layers above and below the given module. In this case the grooves can be constructed parallel to one another, and in the checkerboard arrangement of the modules in each layer is ensured in supplementary fashion, or one of the grooves can be constructed in a longitudinal direction and the other in the crosswise direction.

These variants of lens construction are distinguished by simpler module design, and permit, for the sake of checkerboard arrangement of the modules along the two coordinating planes, an additional decrease in its equivalent electric measure.

To ensure ease of assembly of the centro-symmetric lens in several designs, it makes sense that on one of the sides of each module there be a groove, and on the opposite side a protrusion, and that the longitudinal axes of the groove and the protrusion be arranged along crossing lines, oriented perpendicular to each other, while the modules are located in horizontal layers so that the grooves of all the modules of each layer are arranged in one plane and in the groove of each module from its two opposite ends are inserted protrusions of two adjacent modules, located in the layer above the given module.

For construction of a more monolithic and stable assembly in a variety of adoptions it is necessary that on one pair of opposite sides of each module there be a matching groove and protrusion constructed parallel to each other, and on the other pair of opposite sides grooves be constructed, whose longitudinal axes lie along the crossed lines perpendicular to each other. In this case the greatest width of each groove would be equal to the total width of the side protrusions formed on the edges along both sides from the groove, while the modules would be located in horizontal layers. In each layer the modules would be connected to each other by a protrusion and a groove parallel to it formed on the opposite side, and, in addition, each groove which remains empty after connection with the others in the layer, side protrusions of the two adjacent modules are inserted from the two opposite ends, located in the layers above and below the given module.

BRIEF DESCRIPTION OF THE DRAWINGS

The invention proposed below is explained using concrete examples of its realization and the drawings provided, in which.

BEST MODE FOR CARRYING OUT THE INVENTION

Figure 1:
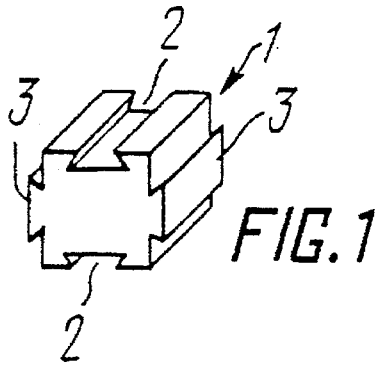
FIG. 1 depicts a first embodiment of module construction with two pairs of parallel grooves and protrusions on its opposite sides, according to the invention.
Figure 2:
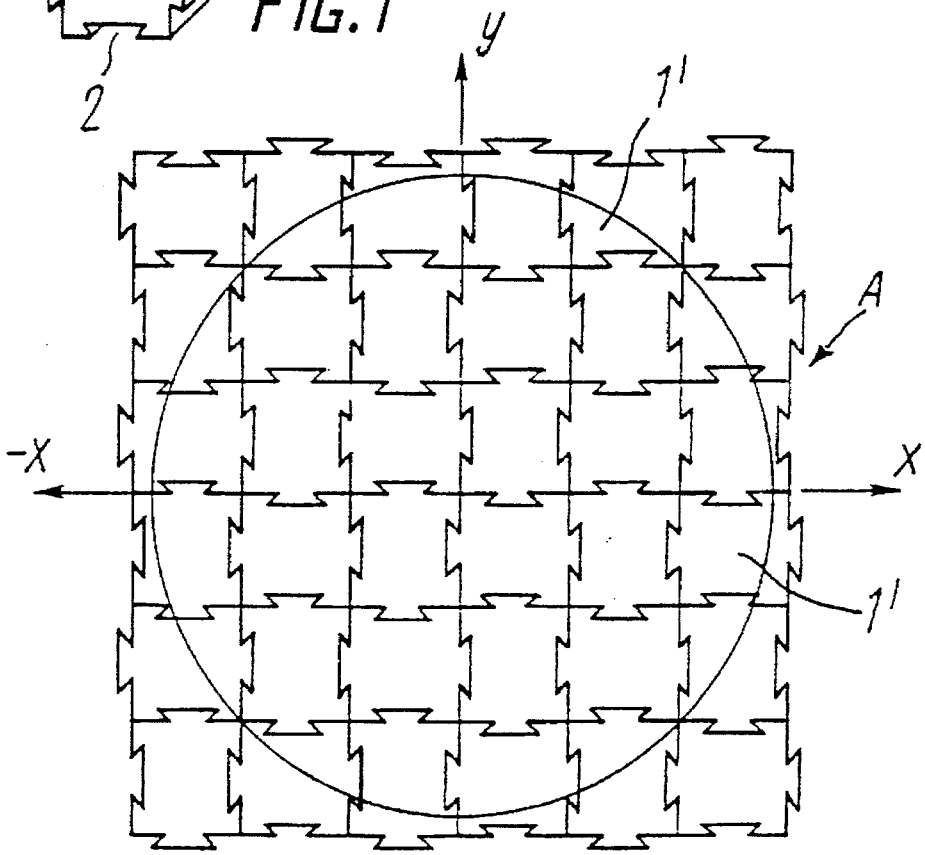
FIG. 2 shows the lens layer, created from the modules of the first construction variant, viewed from above.

The spherical lens with variable refractive index, according to the invention comprises for example modules 1 (FIG. 1), constructed from homogeneous dielectric materials with various values of dielectric permittivity $\in$. Distribution of the permittivity $\in$ in the lens body along the radius r of the lens, which corresponds to the distribution of its refractive index, is achieved by assembling modules 1 in an order determined by the assembly maps for each layer, in which the coordinates of the modules 1 and the $\in$ values corresponding to them are shown. All modules 1 of the interior layers which form the central cubic core inscribed in a sphere, have a cubic form and are equal in size, while the exterior modules 11 (FIG. 2), after their connection to the interior layer modules 1 and mechanical finishing, have the spherical form of their exterior surface to accommodate the core to the sphere of the lens. For connection of the modules 1 (FIG. 1) with one another on one pair of opposite sides of each module 1 grooves 2 are provided with the depth of widening the module 1. The grooves 2 are formed parallel and one against another. On the other pair of opposite sides of module 1 are constructed protrusions 3, also located parallel to each other. The grooves 2 and protrusions 3 have identical lateral cross-sections in pairs. The mutual coupling of the modules 1 is carried out with the aid of grooves 2 and the matching protrusions 3, whereby the modules 1 are arranged in the body of the lens in horizonal layers A, B, C (FIG. 2,3).

Figure 3:
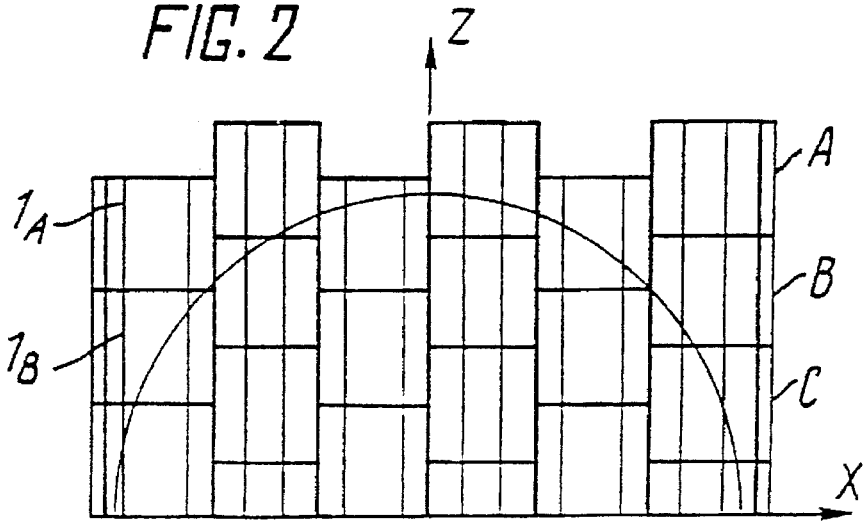
FIG. 3 illustrates a stepped structure of lens layers, from the modules of the first variant of their construction.

The mutual coupling among layers A, B, C (FIG. 3) is ensured by their step structure, in which the adjacent modules 1 are offset relative to one another, for example, at half their height. Such construction of the modules 1 ensures lateral rigidity of the lens design and erosion of the boundaries between the layers A, B, C, making the dielectric lens side more uninterrupted and close to the principle given by theory, without sharp jumps of the permittivity Σ due to the decrease of equivalent electric size of the module.

Figure 4:
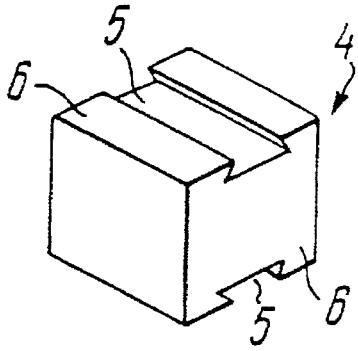
FIG. 4 shows a second embodiment of the module with two parallel grooves on two opposing sides, according to the invention.
Figure 5:
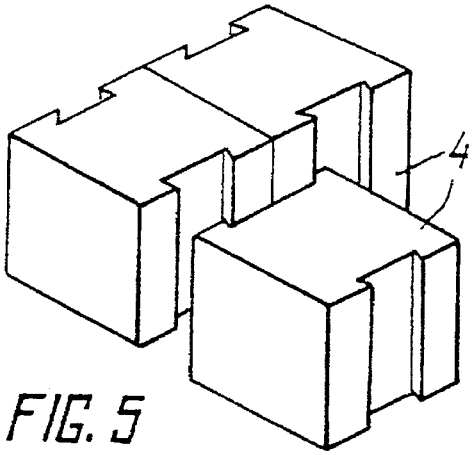
FIG. 5 shows an assembly joint made of three modules of the second embodiment.
Figure 6:
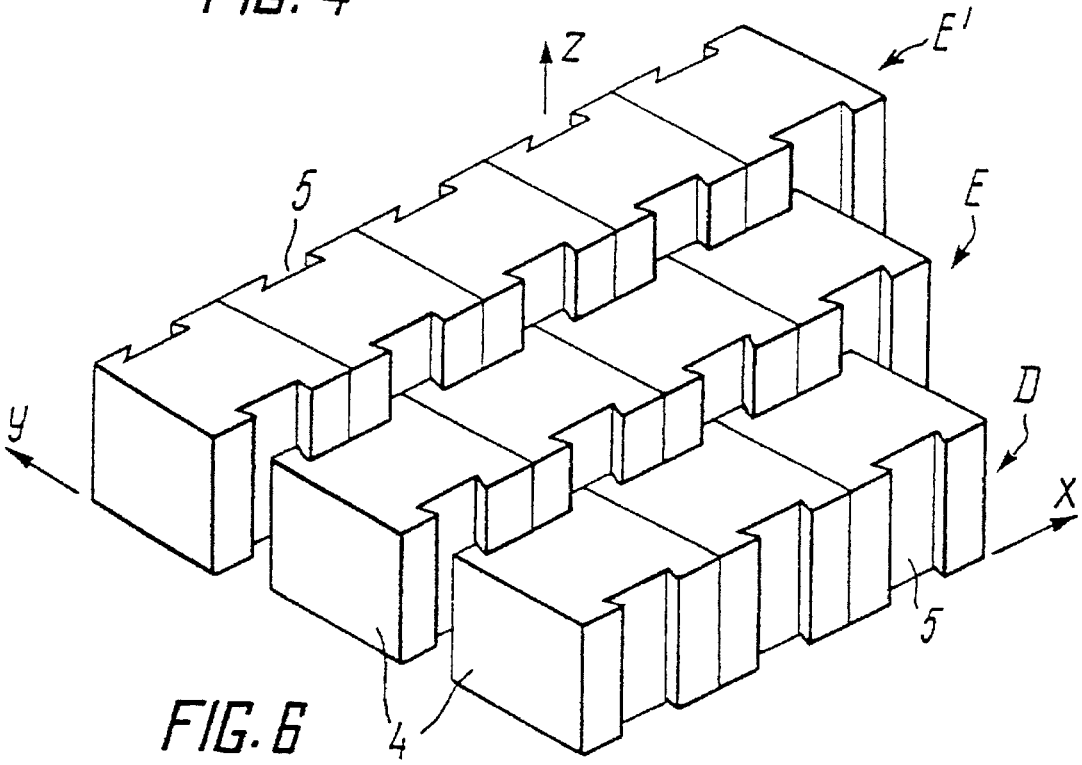
FIG. 6 illustrates a stepped structure of the lens layers from modules of the second embodiment.

In FIG. 4 is shown a simpler design for the module 4, on two opposite sides of which are constructed one against another parallel grooves 5, which widen inside the module 4. The largest width of each groove 5 is equal to the total width of the symmetrical side protrusions formed on the edge along both sides away from groove 5. Upon connection of the modules 4 in each groove 5 (FIG. 5) of each module 4 into two of its opposite ends are inserted two side protrusions 6 of two pairs of adjacent modules 4, thanks to which the staggered arrangement of modules 4 is formed in the layer D, E along coordinate X (FIG. 6). FIG. 6 shows the stepped structure of layers D, E, at which point the coupling of neighboring modules 4 is produced by the rows, which ensures the checkerboard arrangement of modules along coordinate Z.

This variant of lens construction is interesting in comparison to its previous two-dimensional checkerboard structure both in layer D, E—the plane XY, and in the interlayer plane YZ. This characteristic permits an additional decrease in the equivalent electric measure of the module 4.

Figure 7:
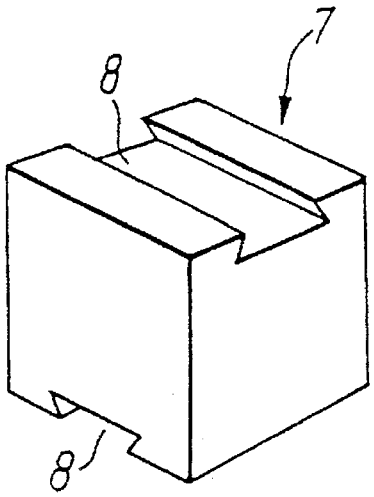
FIG. 7 shows a third embodiment of the module with grooves at crossed directions perpendicular to the orientation toward the two opposite sides, according to the invention.
Figure 8:
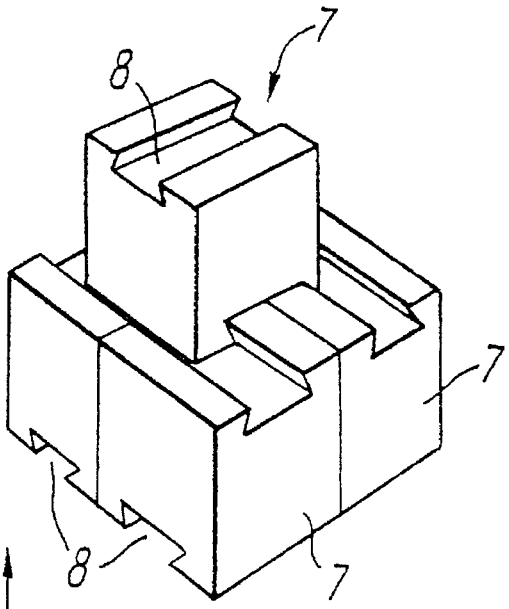
FIG. 8 illustrates an assembly unit of three modules of the third embodiment.
Figure 9:
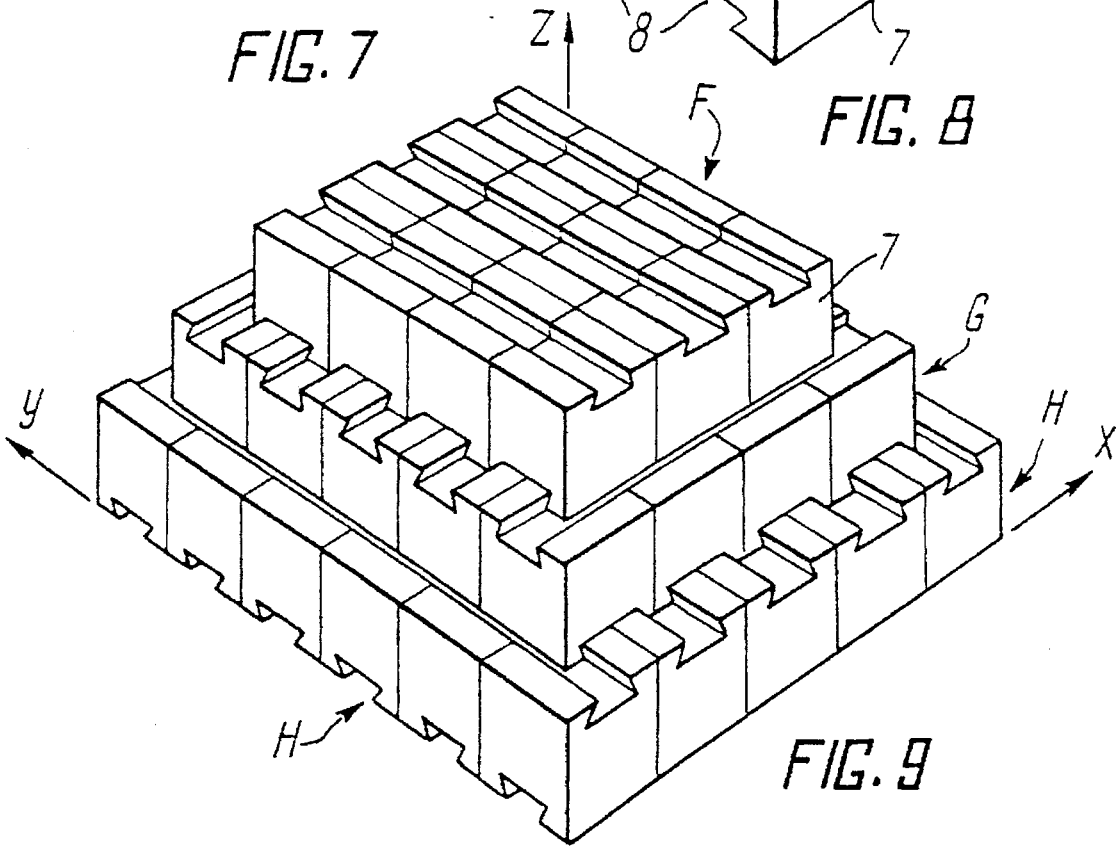
FIG. 9 shows a checkerboard module layout of neighboring lens layers along two coordinates, in projection on a horizontal plane.

The grooves 8 constructed on the opposite sides of the module 7 (FIG. 7) can be arranged so that their longitudinal axes lie on crossing lines of perpendicular orientation. A design of such modules 7 is characterized by the checkerboard structure in the interlayer space—the planes XZ and YZ (FIG. 9).

Figure 10:
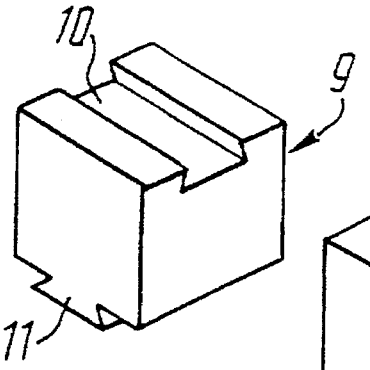
FIG. 10 depicts a fourth embodiment of the module with groove and protrusion on its opposite sides, oriented along crossing lines of perpendicular orientation, according to the invention.
Figure 11:
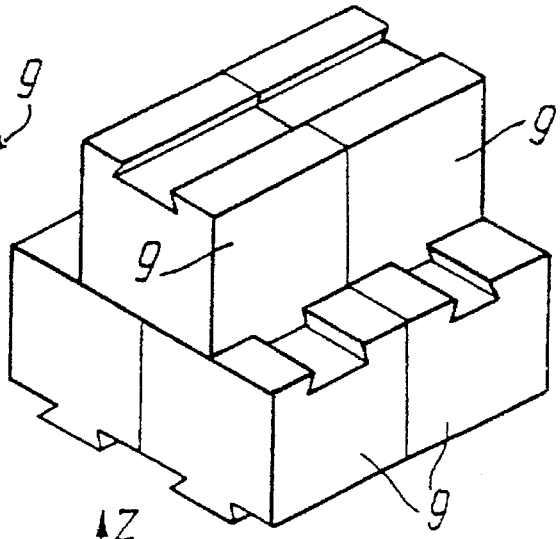
FIG. 11 shows lens unit, made from three modules of the fourth construction variant.
Figure 12:
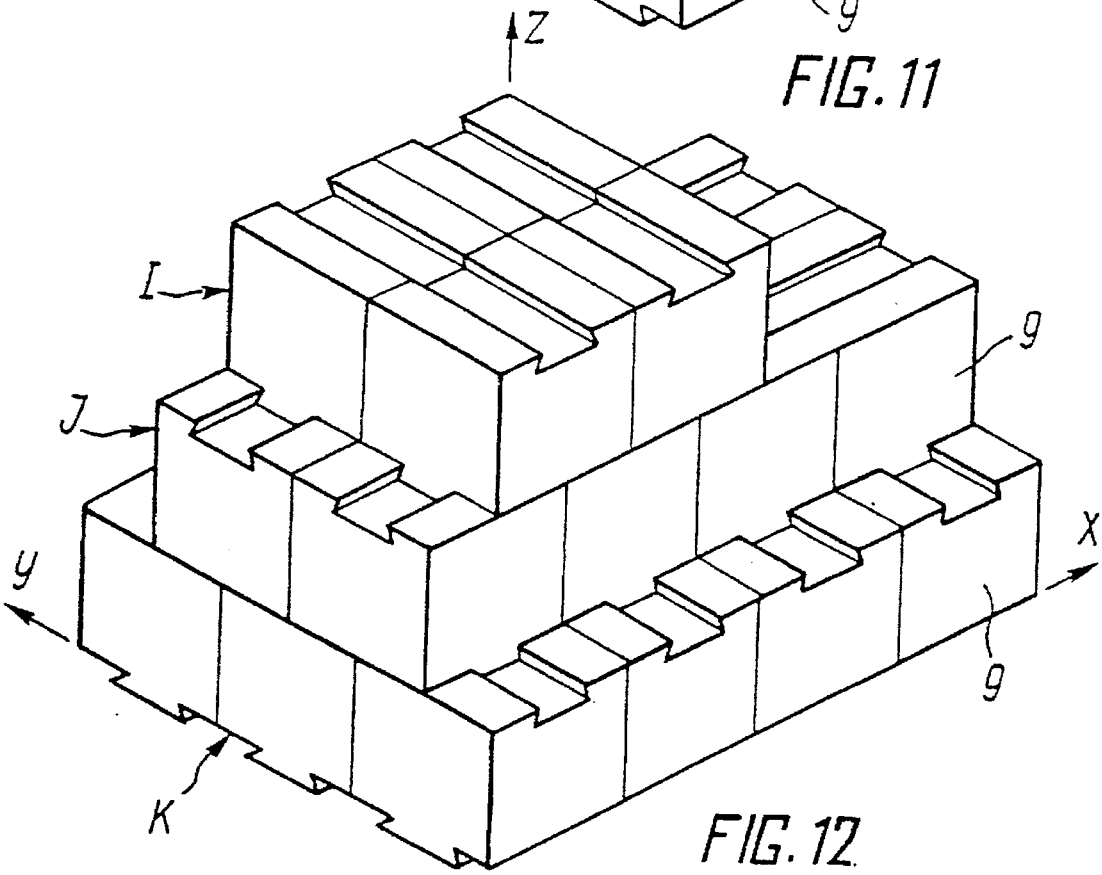
FIG. 12 shows location of the modules in the horizontal lens layers.

For assembly of the centro-symmetric lens it is advisable on two opposite sides of each module 9 (FIG. 10, 11) to construct a groove 10 and protrusion 11, whose longitudinal axes are located along crossing lines of perpendicular orientation. In this case the modules 9 are arranged in horizontal layers I, J, K (FIG. 12) so that in each layer I, J or K the grooves 10 of all modules 9 lie in one plane. As shown in FIG. 11, two adjacent subassemblies of two layers J, K (FIG. 12), from which each module selected from the three modules 9 connects with the others only with the aid of the module 9 layer, which lies above or under them, for example module 9 of the upper layer 1. The design of this variant of lens construction does not permit the creation of checkerboard arrangement of modules 9 inside the layer—plane XY, but also, as in the previous variant, provides for a checkerboard arrangement of modules 9 in the interlayer space.

Figure 13:
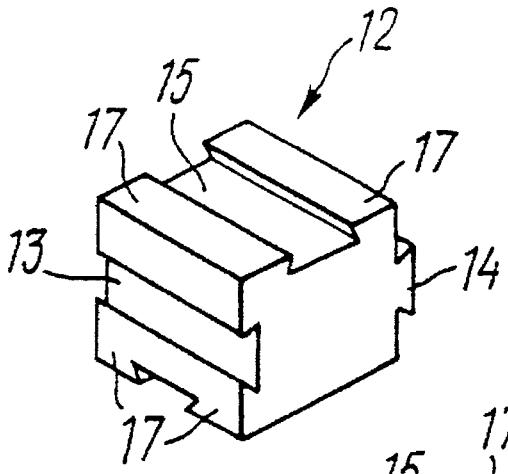
FIG. 13 illustrates a fifth embodiment of the module with grooves and protrusions on its two pairs of opposite sides, according to the invention.
Figure 14:
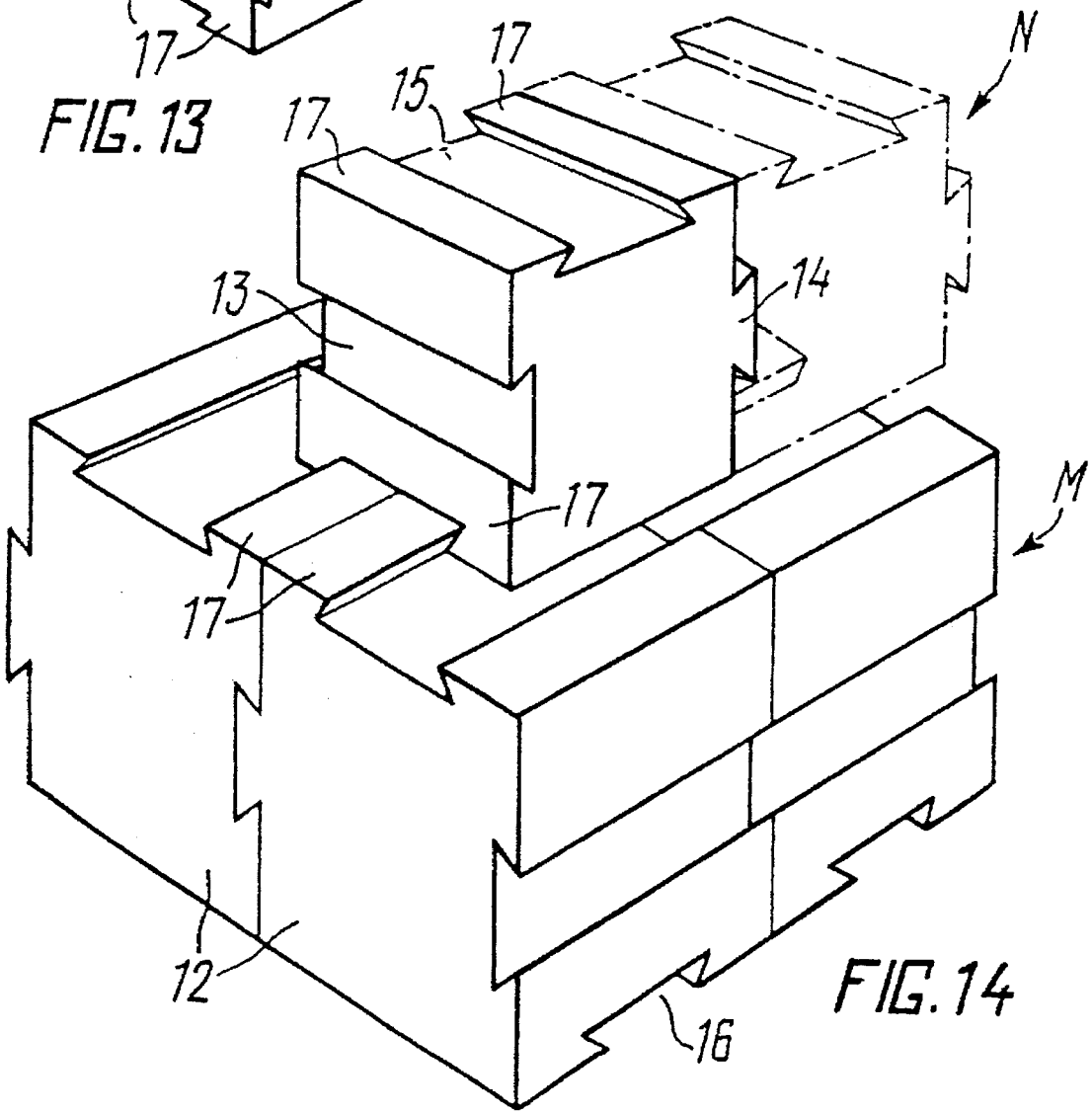
FIG. 14 shows location of the modules in the lens layers.

To make the entire assembly more monolithic and stable, so it will have significant value in a series of applications, the design module 12 (FIG. 13) is more complex. In this case on one pair of opposite sides of the module 12 are constructed a groove 13 and protrusion 14, one against another, and on the other pair of opposite sides—grooves 15 and 16, one of which, for example groove 15, is oriented in a longitudinal direction, while the other, groove 16, is in the crosswise direction. The modules 12 are oriented in the body of the lens in horizontal layers M, N (FIG. 14), so that in each layer M or N modules 12 are connected by means of a protrusion 14 and groove 13. In each remaining free groove 15 and 16 are inserted side protrusions 17, which are formed on the edge along both sides from the groove 15 or 16, two adjacent modules 12, oriented in another layer. As is shown in FIG. 14, in the groove 16 of module 12 located in layer 12 is inserted the side protrusion 17 of module 12, which is located in the lower layer M. At this point the grooves 13 and protrusions 14, which connect the modules 12 in layer M or N, can be distinguished by profile and size from the grooves 15 and 16.

For formation of the dielectric sphere made of modules, two methods are possible. The first consists of a process in which first two half-spheres are assembled on bases, which ensures matching of the stepped structures of the equatorial layer and layers parallel to the equator. On these same bases the mechanical conditioning of the half-sphere to receive the external spherical surface of given dimensions and cleanliness, after which the similarly connected layers are connected to the sphere. Then work on concluding the sphere is carried out and the protective and decorative cover made from two half-spheres is constructed and the power belt is introduced, made, for example, from glass fiber, at the seam of the half-spheres, on which the reinforcing joints are arranged.

The second means differs from the first in that the dielectric lens is produced in a unitary spherical design. The assembly begins in the same way as in the first method, but then, after the assembly of the half-sphere the base is turned over and the half-sphere is placed on a spherical base and the assembly continues until a sphere is formed. Finishing along the sphere is carried out in turns—first one half-sphere, then after it is turned up on its round base and the assembly is completed—the second half-sphere. After this the sphere is finished with the protective and decorative covering, and the reinforcing elements are introduced as in the first method.

Figure 15:
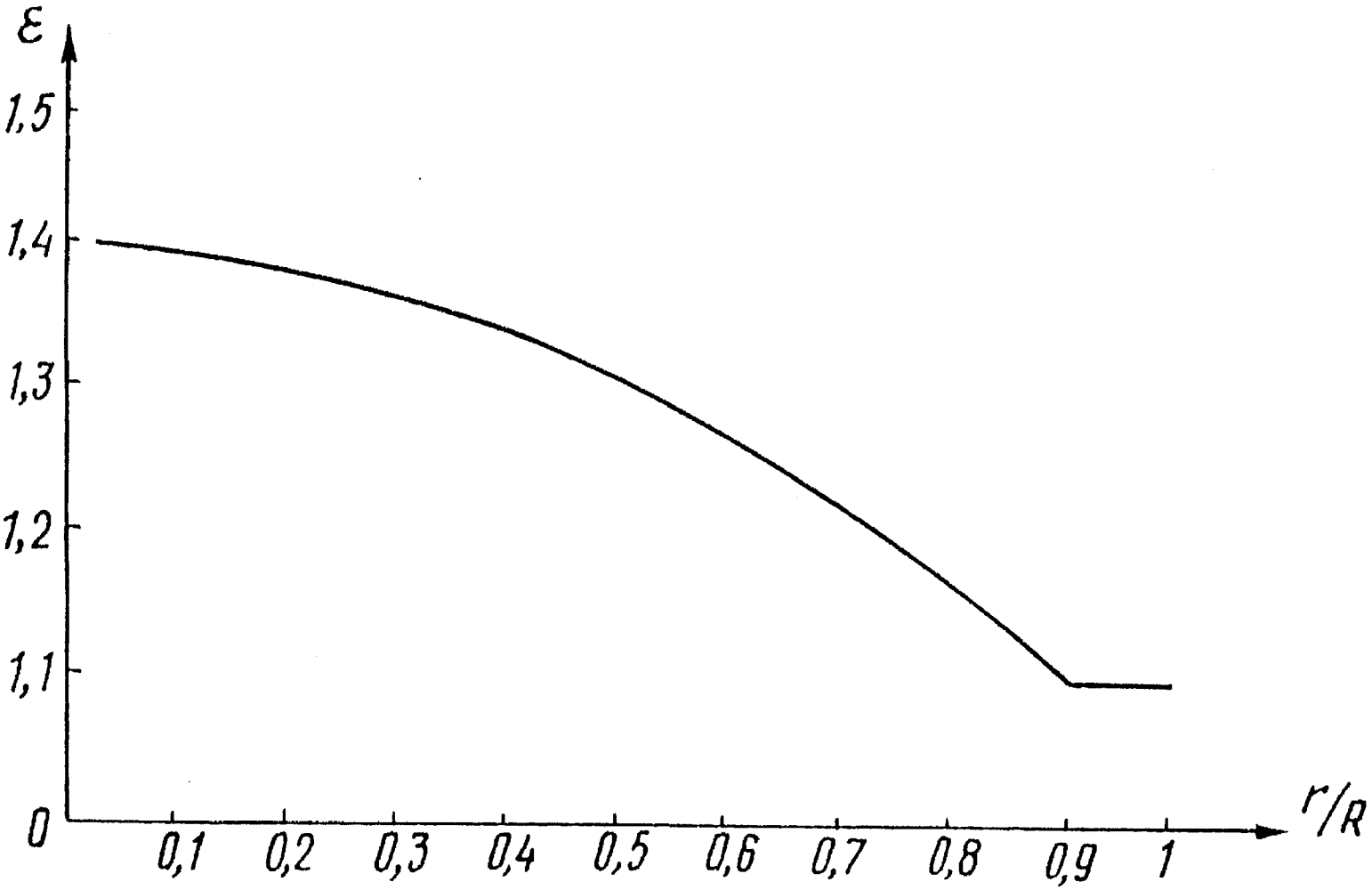
FIG. 15 illustrates dependence of the dielectric permittivity of the lens on the lens radius.

Operation of the proposed lens can be described based on the example of the dielectric centro-symmetric lens. The principle of change of the refractive coefficient which is selected based on the current radius value n (r), for example, in accordance with the work of Morgan (S. P. Morgan. General Solution of the Luneberg lens problem. Jour. Appl. Physics, 29(9), 1958, 1358), where one of the lens foci is extended into infinity, and the opposite focus is located close to the lens surface. One of the possible dependencies of dielectric permittivity $\in (r)=n^2(r)$ is shown in FIG. 15. The centro-symmetric dielectric lens assembled in accordance with this dependence, as is known, works in the following manner. A flat electromagnetic wave falling from infinity on the lens is dispersed inside the lens along the trajectories—the beams, which after passing through the lens medium thanks to its refractive characteristics are focused at the focal point located on the lens, connecting the signal source and the lens center from the side opposite the source.

This process will be more accurate, that is, will be carried out with minimal aberrations, the more closely the n(r) realized is to the principle value.

The lens construction of modules proposed in this patent application permits, in comparison with previous designs, realization of a more precise assembly with minimal tolerance, with minimal possibility of discrete changes in $\in$, and permits a decrease in the jump in the dielectric permittivity at the boundaries between the modules. In addition, such a design does not require the use of adhesive layers, whose dielectric permittivity differs significantly from the desired values. This permits a lens design which approaches the ideal continuous to the desired theoretical dependence of the dielectric permittivity on its radius. For these reasons aberrations in dispersion of electromagnetic waves in the lens medium turn out to be small and do not exceed permissible levels.

In addition, such an assembly turns out to be strong and stable and makes mechanical finishing possible.

Correspondingly, decrease in the lens gain, and increase in the level of its side lobes, distortion in the polar characteristics and other deviations from the ideal lens, correspond strictly in their structure to the theoretical law of Morgan, and also do not exceed permissible values, which permits wide use of the proposed design in engineering practice.

The proposed design variants for spherical dielectric lenses with variable refractive indices presents a wide choice of possibilities for their adoption depending on the operating frequency of the waves, technological characteristics and serial production, use conditions and so forth. They all fulfill the technical task, namely, to ensure minimal labor cost of assembly, improved radio engineering features, and to permit a wide operating range in the proposed design, used also in the short-wave portion of the microwave band, at frequencies in the millimeter wave range.

Industrial Applicability

Preferably, to use the present invention for multi-channel terrestrial communications, in contemporary multi-channel systems of satellite communications and satellite television for simultaneous reception (transmission) of information from various signal sources with equal effectiveness of reception (transmission) in a wide angle sector, and also for passive and active retranslators, radar reflectors and multi-beam radar antennas, for which it should be especially emphasized that it is possible to adopt the proposed lens antenna design in extreme on-board conditions such as on airplanes and on cosmic apparatuses of various types.

We claim:

1. Spherical dielectric lens with variable refractive index, comprising a plurality of homogeneous dielectric modules (1, 4, 7, 9 or 12) having various values of dielectric permittivity and, arranged to establish a predetermined distribution of the dielectric permittivity along the radius of the lens, corresponding to the distribution of its refractive index, wherein said plurality of modules includes a plurality of cubic interior modules arranged within a central cubic core inscribed in a sphere defining an external spherical surface of the lens, and a plurality of exterior modules having spherical outer surfaces forming said external spherical surface of the lens.

2. A spherical dielectric lens with variable refractive index as described in claim 1, wherein on one pair of the opposite sides of each module (1), grooves (2) are constructed in parallel one against another, and on the other pair of sides protrusions are formed (3), whereby the modules (1) are connected to one another by grooves (2) engaged with matching protrusions (3), so that they are arranged in horizontal layers (A, B, C) in each of which the adjacent modules (1) are displaced relative to one another to form stepped boundaries between the layers (A, B, C).

3. A spherical dielectric lens with variable refractive index as described in claim 1, wherein on one pair of opposite sides of each module (4,7) there are grooves (5,8) along its entire length, the greatest width of each groove is equal to the sum of the width of the symmetrical side protrusions (6) formed on the edge along both sides from the groove, so that the modules (4,7) are arranged in horizontal layers (E, E', D, F, G, H), and in each groove (5,8) of each module (4,7) side protrusions (6) of two pairs of adjacent modules (4, 7) are inserted from its two opposite ends, which are located relative to the given module (4,7) respectively in the upper and lower layers (E', D, F, H).

4. A spherical dielectric lens with variable refractive index as described in claim 3, wherein the grooves (5) are constructed parallel one against the other.

5. A spherical dielectric lens with variable refractive index as described in claim 3, wherein one of its grooves (8) is constructed in a longitudinal direction, while the other is in a crosswise direction.

6. A spherical dielectric lens with variable refractive index as described in claim 1, wherein on one of the sides of each module (9) is constructed a groove (10) and on the opposite side a protrusion (11), and the longitudinal axis of the groove (10) and the protrusion (11) are arranged on crossing lines, oriented perpendicular to each other, while the module (9) is placed in horizontal layers (I, J, K) so that the grooves (10) of all modules (9) of each layer (I, J, K) are located in one plane and into the module from its two opposite ends are inserted the protrusions (11) of two adjacent modules located in the layer (I, K) lying above the module (9).

7. A spherical dielectric lens with variable refractive index as described in claim 1, wherein on one pair of the opposite sides of each module (12) are constructed the matching groove (13) and protrusion (14) parallel one to another, and on the opposite pair of sides are constructed grooves (15, 16), whose longitudinal axes are located along crossing lines, oriented perpendicular to each other, where the greatest width of each groove (15,16) is equal to the sum width of the side protrusions (17) formed on the border along both sides, while the modules (12) are arranged in horizontal layers (M, N) in each of which they are connected with one another by means of a protrusion (14) and a groove (13) formed on the opposite side parallel to it, and, in addition, in each module groove (15, 16), which remains free after connecting it with the others in the layer, side protrusions (17) are inserted from two opposite ends of the two adjacent modules (12) located in the layers above and below the given module (M).

8. A dielectric lens antenna comprising a plurality of homogeneous dielectric modules having various values of dielectric permittivity and arranged so as to provide a predetermined distribution of the dielectric permittivity along a radius of the lens antenna, each of said dielectric modules having at least a pair of opposite rectangular sides lying in parallel planes, and including means arranged on said sides, for engaging said dielectric modules with each other.

9. The antenna of claim 8, wherein said engaging means comprises a groove and a protrusion.

10. The spherical dielectric lens of claim 8, wherein a value of dielectric permittivity of each dielectric module is selected in accordance with coordinates of location of the module in said spherical dielectric lens.

11. The spherical dielectric lens of claim 10, wherein said dielectric modules are arranged in a three-dimensional structure, in which locations of the modules are defined by an XYZ rectangular coordinate system.

12. The antenna of claim 11, wherein said engaging means comprises a pair of grooves formed on the opposite sides of the module.

13. The spherical dielectric lens of claim 11, wherein said three-dimensional structure forms a dielectric centro-symmetric lens.

14. The spherical dielectric lens of claim 11, wherein said engaging means comprises a pair of engaging elements arranged on the opposite sides of the module in directions perpendicular with respect to each other.

15. The spherical dielectric lens of claim 11, wherein said engaging means comprises a pair of grooves arranged on the opposite sides of the module in directions perpendicular with respect to each other.

16. The spherical dielectric lens of claim 11, wherein said engaging means comprises a groove and a protrusion arranged on the opposite sides of the module in directions perpendicular with respect to each other.

17. The spherical dielectric lens of claim 11, wherein said engaging means comprises a first pair of engaging elements arranged on a first pair of the opposite sides of the module in the same direction, and a second pair of engaging elements arranged on a second pair of the opposite sides of the module in directions perpendicular with respect to each other.

18. The spherical dielectric lens of claim 11, wherein said engaging means comprises a first groove and a first protrusion arranged on first pair of the opposite sides of the module in the same direction, and second and third grooves arranged on a second pair of the opposite sides of the module in directions perpendicular with respect to each other.

* * * * *